United States Patent [19]

Marx et al.

[11] 4,446,602

[45] May 8, 1984

[54] MACHINE OPERATOR PROTECTION SYSTEM

[75] Inventors: Hans-Jürgen Marx; Fritz P. Hösel, both of Mönchengladbach, Fed. Rep. of Germany

[73] Assignee: Trützschler GmbH & Co. KG, Mönchengladbach, Fed. Rep. of Germany

[21] Appl. No.: 296,486

[22] Filed: Aug. 26, 1981

[30] Foreign Application Priority Data

Aug. 29, 1980 [DE] Fed. Rep. of Germany ..... 3032584

[51] Int. Cl.[3] ..... D01G 31/00; D01G 7/12

[52] U.S. Cl. ..... 19/0.21; 19/80 R; 19/81; 250/221

[58] Field of Search ..... 19/0.21, 80 R, 81; 250/221

[56] References Cited

U.S. PATENT DOCUMENTS

| | | | |
|---|---|---|---|
| 3,443,285 | 5/1969 | Goldammer et al. | 19/81 |
| 3,711,846 | 1/1973 | Schlisser | 250/221 X |
| 3,851,168 | 11/1974 | Erbstein | 250/221 |
| 3,951,282 | 4/1976 | Keller | 19/80 R |
| 4,004,805 | 1/1977 | Chen et al. | 250/221 X |
| 4,087,882 | 5/1978 | Keller | 19/81 |
| 4,107,820 | 8/1978 | Mahrt et al. | 19/81 |
| 4,297,766 | 11/1981 | Trützschler | 19/80 R |
| 4,347,438 | 8/1982 | Spielman | 250/221 |

FOREIGN PATENT DOCUMENTS

| | | | |
|---|---|---|---|
| 2944588 | 5/1981 | Fed. Rep. of Germany | 250/221 |
| 3032584 | 6/1982 | Fed. Rep. of Germany | 19/0.21 |
| 1262031 | 2/1972 | United Kingdom . | |
| 1342144 | 12/1973 | United Kingdom . | |
| 1363468 | 8/1974 | United Kingdom . | |
| 1448987 | 9/1976 | United Kingdom . | |
| 1457582 | 12/1976 | United Kingdom . | |
| 1462235 | 1/1977 | United Kingdom . | |
| 1539570 | 1/1979 | United Kingdom . | |
| 2060113 | 4/1981 | United Kingdom . | |

OTHER PUBLICATIONS

Kurt Trulley, "Beispiele zur Sicherung von Gefahrenstellen an Textilmaschinen", Spinner Weber Textilveredlung, No. 9, 1962, pp. 851–855.

*Primary Examiner*—Louis Rimrodt

*Attorney, Agent, or Firm*—Spencer & Frank

[57] ABSTRACT

A system for monitoring and securing a zone associated with a power driven textile machine, which machine includes a part which moves when the machine is in operation in a manner to endanger an individual present in the zone, which system includes a radiation emitting device for producing a beam of directed radiation and for directing such beam along a path coincident with at least one boundary of the zone, a radiation responsive device positioned in the path of the radiation beam for producing an output indication when it is not receiving the directed radiation and a control unit connected to the radiation responsive device for halting movement of the part in response to appearance of the output indication.

10 Claims, 10 Drawing Figures

+24 V
54
56
E4
I4
F4
G4
E
I
0V

G2
F2
E2
56 to Transmitter
e.g. 10 e.g. to 34
E5
I5
F5
G5
55

From Receiver
e.g. 14
I1
F1
G1
57
F
G

MACHINE OPERATOR PROTECTION SYSTEM

BACKGROUND OF THE INVENTION

The present invention relates to an apparatus for monitoring and securing accessible danger areas at power driven textile machines, particularly bale openers for textile fiber bales emloying movable fiber removal members.

In order to prevent accidents at power driven textile machines, particularly those incorporating movable elements, a known measure involves the provision of a main power switch. Actuation of the main power switch by a person immediately interrupts the power supply to the drive of the machine, i.e. the drive for the machine is cut off. However, since the main power switch is disposed on the movable element itself, the danger of accidents during manipulations at the machine is not completely eliminated.

SUMMARY OF THE INVENTION

It is an object of the present invention to interrupt a machine movement which is endangering an individual even without contact by a person.

The above and other objects are achieved, according to the invention, by a system for monitoring and securing a zone associated with a power driven textile machine, said machine including a part which moves when the machine is in operation in a manner to endanger an individual present in the zone, which system includes radiation emitting means for producing a beam of directed radiation and for directing such beam along a path coincident with at least one boundary of the zone, radiation responsive means positioned in the path of the radiation beam for producing an output indication when it is not receiving the directed radiation, and control means connected to the radiation responsive means for halting movement of the part in response to appearance of the output indication.

With such a monitoring and safety arrangement, no physical contact with the moving element of the machine is necessary to switch off the machine, or the moving part, since the drive therefor is already switched off if a person comes too close to the machine or the part. Advisably, photoelectric barriers are used for this purpose. However, other, preferably highly directional, radiation emitters and receivers can also be employed, e.g. lasers, infrared light, ultrasound or the like.

Preferably, when the moving element, such as a removal member in the case of a bale opener, is in the operating position, the associated danger zone is secured by a safety device, e.g. a photoelectric barrier, and whenever the moving element turns into another operating position, a signal generator switches from one safety device, e.g. for one danger zone, to another safety device, e.g. for a different danger zone.

In this way it is possible to automatically secure the danger areas of the machine which may change in the course of the working process, so that only the area which currently presents a danger is being monitored while the remaining area remains freely accessible. While work proceeds in the danger area, new fiber bales can be set up in the remaining area.

Advisably the switching occurs after a complete rotation of the removal member of a bale opener through about 180°. The safety device and with it the drive are switched on only if the removal member is in the precise operating position. In this way it is assured that removal of fiber from fiber bales occurs in a straight line. If the working member has reached its operating position, a switch must be actuated which emits a signal for both the safety device and for the drive.

Preferably the signal generator for the safety device is a push button which is actuated by the removal member. According to a particularly preferred embodiment, the holding device for the removal member has a horizontal opening, when seen in the operating direction, i.e. a passage for the beams of the photoelectric barrier or the like. In this way, one photoelectric barrier, i.e. the photoelectric barrier associated with the removal member when it is in the operating position, is used simultaneously for two different safety devices. This arrangement is of advantage if very large danger zones are to be secured for which the beam power of a single photoelectric barrier is not sufficient.

Embodiments of the invention have the form of an apparatus for monitoring and securing accessible danger areas around power driven textile machines, particularly bale openers for textile machines having movable removal members, and includes a transmitter and a receiver between which a beam passes, an interruption of the beam path between the transmitter and the receiver actuating a signal which is used to directly interrupt the dangerous movement of the power driven operating means, and the holding device for the removal member is provided with a horizontal opening, when seen in the operating direction, for the passage of the beam.

DESCRIPTION OF THE PREFERRED EMBODIMENTS

Figure 1:
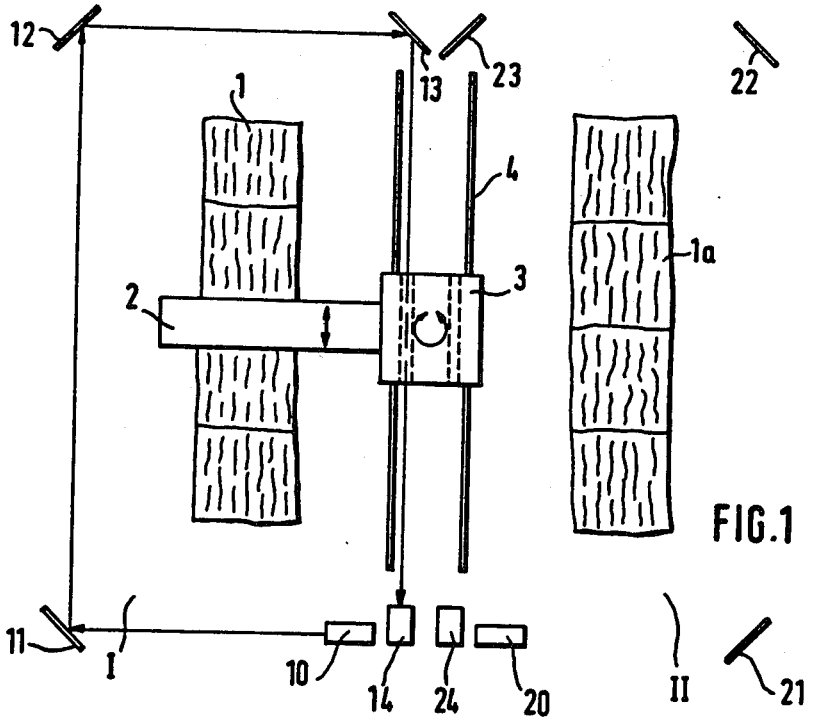
FIG. 1 is a simplified pictorial plan view of an embodiment of apparatus according to the invention with two photoelectric barriers each in a first position.

FIG. 1 shows a bale opener presenting two danger zones I and II which are secure by means of two photoelectric barriers each composed of a light beam emitter 10 or 20, deflecting mirrors 11, 12 and 13 or 21, 22 and 23, and a light receiver, e.g. a photoelectric sensor, 14 or 24.

To secure danger zone I, emitter 10 sends a light beam which is deflected in successsion by mirrors 11, 12 and 13 to the receiver 14. The beam path of the photoelectric barrier 10 to 14 in this way forms a rectangular perimeter which completely encloses, within danger zone I, a row of fiber bales 1 and a movable removal member 2 as well as part of the movable support device 3 carrying member 2. The beam path from transmitter 10 to receiver 14 is shown by arrows. The removal member 2 and the holding device 3 are mounted to move along rails 4 in the direction shown by a double arrow associated with device 2.

On the other side of the holding device 3, the second photoelectric barrier 20 to 24 is provided for enclosing the danger zone II, this barrier including the transmitter 20, the deflecting mirrors 21, 22, and 23 and the receiver 24. While the photoelectric barrier 10 to 14 for the danger zone I is in operation, the photoelectric barrier 20 to 24 for danger zone II is deactivated.

If the light beam of the actuated barrier is interrupted, all movement of the removal member 2 and of the holding device 3 is braked and stopped. The holding member 3 can be rotated about a vertical axis through an angle of 180°, as indicated by the circular double arrow, so that the removal member 2 is placed above the row of fiber bales 1*a* in danger zone II.

Figure 2:
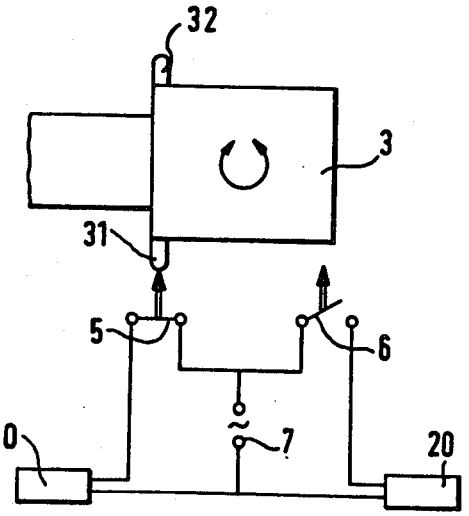
FIG. 2 is a partly schematic, partly pictorial view of a switching device with push buttons usable in the apparatus of FIG. 1.

The protective system according to the invention, as depicted in FIG. 1, may be provided with a barrier actuating system such as that shown in FIG. 2 where the holding device 3 is provided with two lateral projections 31 and 32 each of which can close a respective push button switch 5 or 6 when rotated into either one of two angular positions spaced 180° apart. The push button switches 5 and 6 are part of a circuit which includes the transmitters 10 and 20 and a voltage source 7. By closing one push button switch 5 or 6, the respective associated transmitter 10 or 20 is put into operation. In this way switching is effected from photoelectric barrier 10-14 for danger zone I to photoelectric barrier 20-24 for danger zone II, and vice versa.

Figure 3:
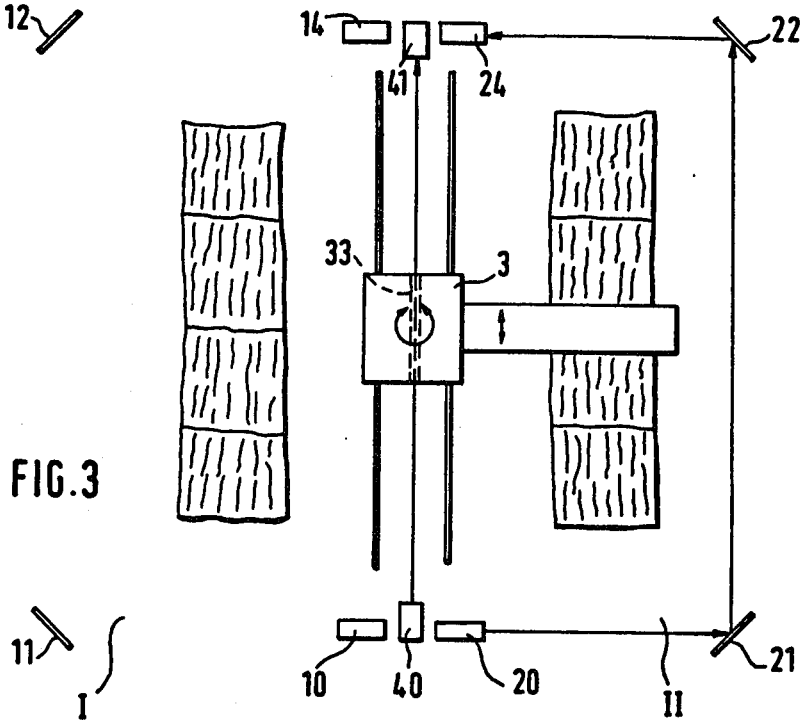
FIG. 3 is a plan view similar to that of FIG. 1 of an embodiment of an apparatus employing three photoelectric barriers in a second position.
Figure 4:
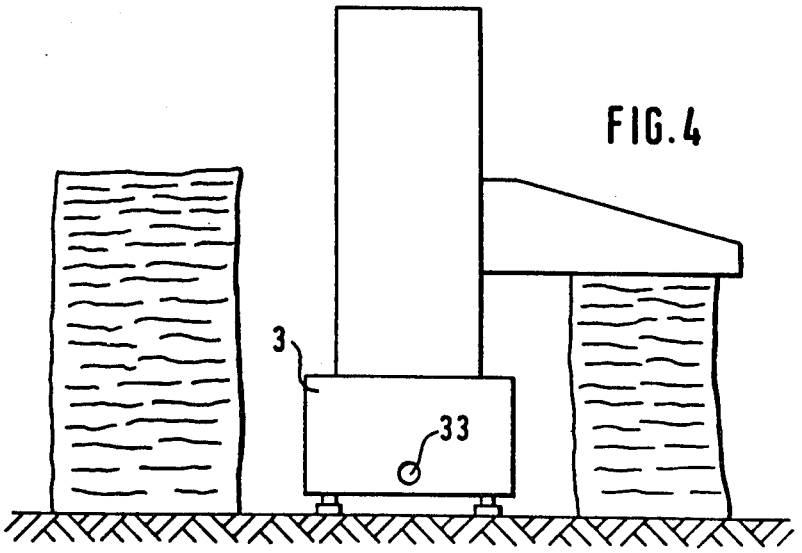
FIG. 4 is a simplified pictorial elevational view of the apparatus of FIG. 3.

FIG. 3 shows a second embodiment of the invention in which each photoelectric barrier 10-14 and 20-24 forms three sides of a rectangle with the remaining side being located in the area of the holding device 3. In this area a third photoelectric barrier including a transmitter 40 and receiver 41 is arranged to extend in the direction of travel of the holding device 3. This photoelectric barrier 40, 41 is always actuated, i.e. also while switching between photoelectric barriers 10-14 and 20-24 is taking place. The transmitter 40 sends a beam through a horizontal passage 33 disposed in the middle of the lower region of the holding device 3 when seen in the operating direction, parallel to tracks 4, as shown in FIG. 4.

Figure 5:
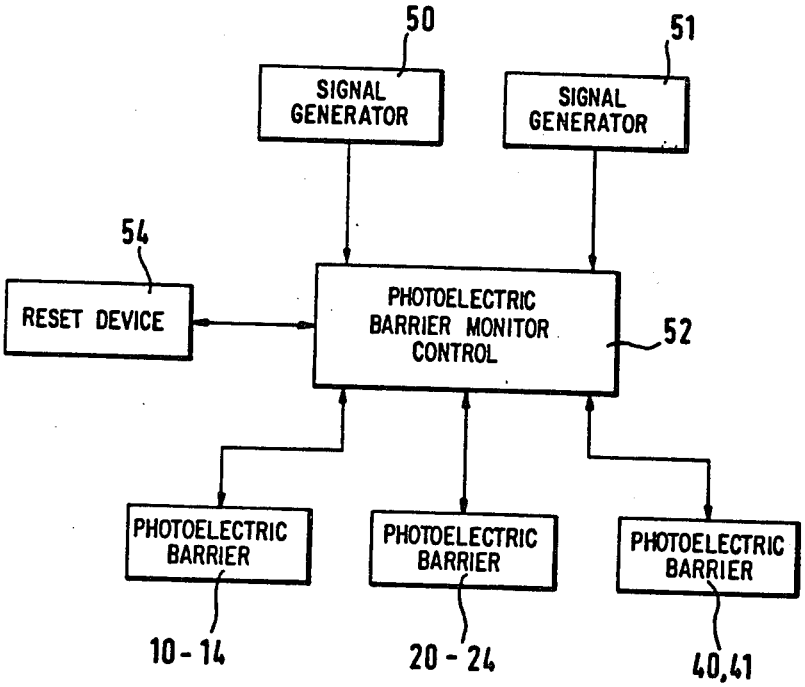
FIG. 5 is a block circuit diagram for an embodiment of a signal processing circuit for a safety system according to the invention.

In the signal processing circuit of FIG. 5, the signal generator 50, which may be push button switch 5, emits a signal when the machine 2, 3 is positioned to operate in danger zone I while the signal generator 51, which may similarly be push button switch 6, emits a signal when the machine 2, 3 is positioned to operate in danger zone II. The signal from either generator is received in a photoelectric barrier monitor control 52 which is associated with the corresponding photoelectric barriers 10-14, 20-24, and 40, 41 of the safety system. A reset device 54 is also associated with the control for resetting the system after it has been actuated.

The photoelectric barrier 40, 41 is always in operation. If neither of the two signal generators 50, 51 is emitting radiation, the machine 2, 3 cannot be switched on, or is switched off. In this way, the correct operating positions of the removal members 2 and of the holding device 3 are monitored simultaneously.

Figure 6:
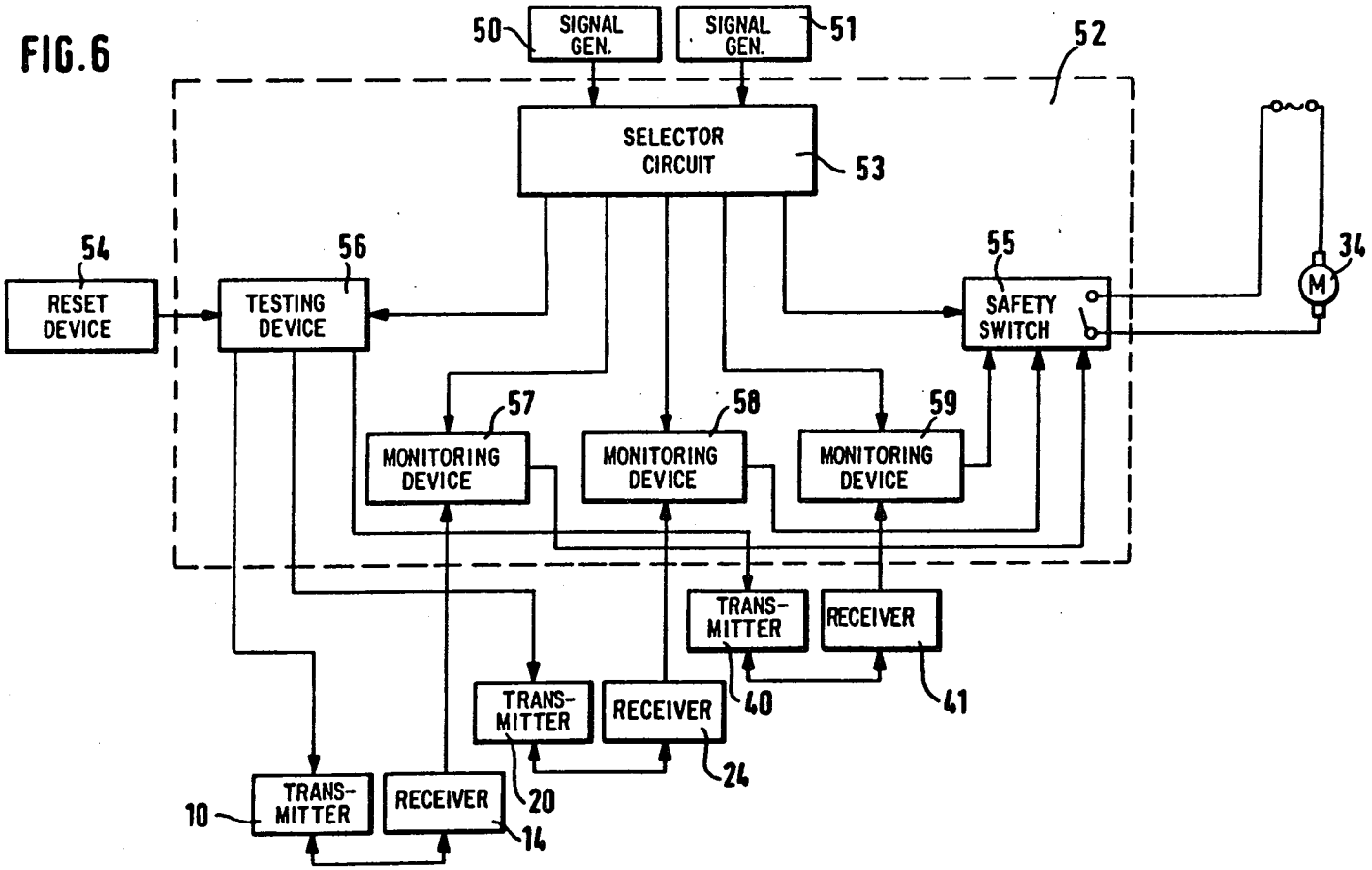
FIG. 6 is a block circuit diagram of a specific form of construction of the circuit of FIG. 5.

The specific circuit of FIG. 6 performs the further function of permitting testing of the safety system. In the circuit of FIG. 6 the barrier control monitor 52 includes a selector circuit 53 to which the signal generators 50 and 51 are connected to provide a signal identifying the present operating position of machine 2, 3, and particularly of device 3. Selector circuit 53 is electrically connected to three monitoring devices 57, 58 and 59, each associated with a respective one of the barriers 10-14, 20-24 and 40, 41, as well as to a safety switch 55 and a testing device 56.

Safety switch 55 is connected in the power supply circuit of a motor 34 which is the drive motor for holding device 3. Testing device 56 is actuatable by a reset device 54 which may be a switch which must be unlocked by a special key before it can be operated.

In the operation of the circuit of FIG. 6, movement of device 3 into one of its operating positions actuates one of the signal generators 50 or 51 to produce a signal which causes the selector circuit 53 to in turn actuate a selected one of light barriers 10-14 and 20-24 and barrier 40-41. Selector circuit 53 can do this, for example, by activating all three transmitters 10, 20 and 40 via testing device 56 and by activating the monitoring devices 57 or 58 and 59 associated with the selected barriers. Switch 55 can be connected to initially be closed upon actuation of a signal generator and subsequently opened upon production of an output signal by any monitoring device when that device is activated and the light beam transmission path between its associated transmitter and receiver has been interrupted.

At the start of operation, the selected barriers can be checked by operating reset device 54 to cause testing device 56 to initiate a simulated malfunction, as by interrupting the supply of operating power to all transmitters. If the result is positive, power is again supplied to the transmitters and reset device 54 is switched to a normal operating position. Preferably, the circuit components are interconnected so that switch 55 does not close until device 54 has been switched to this normal operating position.

If during operation of the machine, a light beam is interrupted, all movement of the operating member 2 and of the holding device 3 is stopped, and restarting is possible only by operating the reset device 54. The reset device 54 is advisably so located that the operator must first step entirely away from the danger zone I or II, respectively, of the machine 2, 3 before the machine can be switched on again, i.e. the operator must check out the danger zone I or II. The spatial arrangement is advisably such that the reset device is at the end of the machine opposite the operator's penal. The entire control system is preferably constructed using relays in such a manner that if there is a drop in voltage or a defect, the machine 2, 3 is always switched off.

Figures 7, 7A, 8, 9:
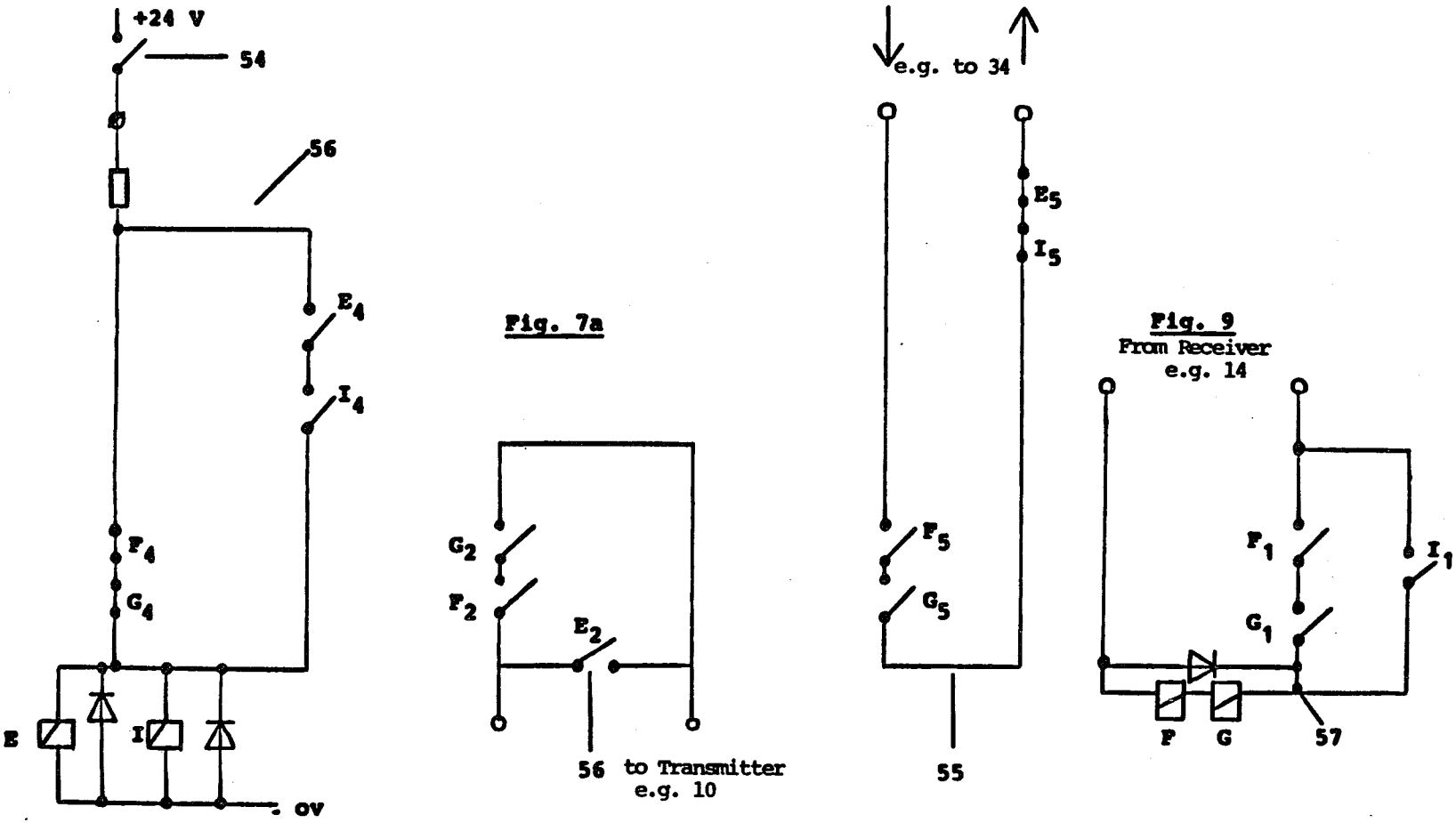
FIGS. 7, 7*a*, 8 and 9 are circuit diagrams of suitable embodiments of components of the circuit of FIG. 6.

One suitable embodiment of elements 54, 55 and 56 of the circuit of FIG. 6 is shown in FIGS. 7, 7*a*, 8 and 9. FIG. 7 illustrates the circuitry of a portion of testing device 56, together with reset device 54, which has the form of a simple pushbutton switch that is normally open. FIG. 7*a* shows a second portion of testing device 56, this being the portion connected to control the actuation of a respective light beam transmitter, for example transmitter 10. FIG. 8 illustrates an embodiment of safety switch 55 connected to control the supply of operating power to motor 34. Finally, FIG. 9 shows one of the monitoring devices, specifically monitoring device 57 connected to monitor the output signal from receiver 14. Not shown are the connections from selector circuit 53, which additionally control the light barrier selection and enablement of safety switch 55 in response to actuation of a respective one of the generators 50 and 51.

FIGS. 7 and 9 illustrate relay coils E, F, G and I, and their associated contacts, all of which bear the same reference character and are shown in their normal position, that is the position when their associated relay coil is deenergized. The terminals of the circuit portion shown in FIG. *7a* are connected in circuit with an associated light beam transmitter, for example transmitter 10,and actuate the associated transmitter when a short circuit appears across those terminals. Similarly, the terminals of the circuit shown in FIG. 8 are connected in series with motor 34 so that the motor will be supplied with operating power only when a short circuit appears across those terminals. Finally, the terminals of the circuit of FIG. 9 are connected across the output of an associated light beam receiver 14 so that a voltage appears across those terminals when a light beam is impinging on the associated receiver.

At the start of operation, reset switch 54 is closed, and held in the closed position, so that an energizing voltage is applied via normally closed contacts $F_4$ and $G_4$ across relay coils E and I. This closes relay contacts $I_1$, $E_2$, $I_4$ and $E_4$, and opens contacts $I_5$ and $E_5$. As a result, a current path for maintaining relay coils E and I energized is established, light beam transmitter 10 is turned on and the output of receiver 14 is connected across relay coils F and G, thereby energizing the latter if receiver 14 is receiving a light beam.

Energization of relay coils F and G opens contact $F_4$ and $G_4$, while closing contacts $F_1$ and $G_1$ to provide a second connection path to relay coils F and G, closing contacts $F_2$ and $G_2$ to provide a second current path for maintaining transmitter 10 energized, and closing contact $F_5$ and $G_5$. Since coils E and I are still energized, contacts $E_5$ and $I_5$ remain open, so that no power can yet be supplied to motor 34. In this operating state, light barrier 10-14 can be broken for testing purposes. This will cause relay coils F and G to be deenergized, and this can be observed in any suitable manner. When the light barrier is restored, relay coils F and G will be reenergized, via contact $I_1$, and all of the F and G contacts will therefore again be returned to their positions associated with energization of their respective relay coils.

After testing has been completed, reset button 54 is opened, whereupon relay coils E and I are deenergized while coils F and G remain energized to maintain transmitter 10 and the monitoring device associated with receiver 14 active and to supply operating power to motor 34. If, during subsequent operation of the system, the light beam to receiver 14 should be blocked, i.e. the light barrier should be broken, relay coils F and G will be deenergized, as a result of which transmitter 10 will be deactivated and motor 34 will be halted.

It will be understood that the above description of the present invention is susceptible to various modifications, changes and adaptations, and the same are intended to be comprehended within the meaning and range of equivalents of the appended claims.

What is claimed is:

1. A system for monitoring and securing a selected one of a plurality of danger zones associated with a power driven machine for opening textile fiber bales, which machine includes a removal member mounted for displacement between two operating positions each associated with a respective danger zone, the removal member being driven, when it is in a selected operating position and the machine is in operation, to move in a manner to endanger an individual present in the respective zone associated with that position, said system comprising: radiation emitting means associated with each danger zone for producing at least one beam of directed radiation which is directed along a substantially closed path which completely encloses its associated danger zone; radiation responsive means positioned in the path of the radiation beam associated with each danger zone for producing an output indication when the at least one beam is interrupted at any point along the substantially closed path; control means connected to said radiation responsive means for halting movement of the removal member in response to appearance of such output indication; and signal generator means responsive to displacement of the removal member between its operating positions for actuating only that one of said radiation emitting means and its associated radiation responsive means whose beam path encloses that zone associated with the existing operating position of the removal member.

2. An arrangement as defined in claim 1 wherein the removal member is displaceable by rotation through an angle of 180° between its two operating positions.

3. An arrangement as defined in claims 1 or 2, wherein said signal generators are constituted by push-button switches.

4. An arrangement as defined in claim 1 wherein the machine includes a support for the removal member, which support is provided with a horizontal passage through which the beam path extends.

5. A system as defined in claim 1 wherein said control means comprise a monitoring device connected to monitor the output of said radiation responsive means and to produce an output signal in response to production of an output indication by said radiation responsive means, and a safety switch connected to said monitoring device for halting movement of the removal member in response to production of an output signal by said monitoring device.

6. A system as defined in claim 5 further comprising testing means operatively associated with said radiation emitting means, said radiation responsive means and said safety switch for permitting the operation of said radiation emitting means and said radiation responsive means to be tested while preventing movement of the removal member.

7. A system as defined in claim 6 wherein said testing means comprise a reset switch movable between a first position in which it permits said radition emitting means and said radiation responsive means to be placed into operation while preventing movement of the removal member, and a second position in which it permits movement of said removal member while permitting said radiation emitting means and said radiation responsive means to remain in operation.

8. An arrangement as defined in claim 1 wherein said radiation emitting means associated with each zone produce at least two beams constituting respective parts of the associated substantially closed path, and said radiation responsive means associated with each zone comprise at least two radiation receivers, each disposed for receiving a respective beam of the associated closed path.

9. An arrangement as defined in claim 8 wherein said radiation emitting means and said radiation responsive means are arranged for causing at least one of the two beams associated with each zone to be common to both danger zones.

10. An arrangement as defined in claim 1 wherein said radiation emitting means and said radiation responsive means are arranged for causing the closed path associated with one danger zone to differ spatially at least in part from the closed path associated with the other danger zone.

* * * * *